US005387169A

United States Patent [19]

Wang

[11] Patent Number: 5,387,169

[45] Date of Patent: Feb. 7, 1995

[54] HORIZONTAL STEPPER

[75] Inventor: Leao Wang, Taichung Hsien, Taiwan, Prov. of China

[73] Assignee: Greenmaster Industrial Corp., Taiping Hsiang, Taiwan, Prov. of China

[21] Appl. No.: 186,115

[22] Filed: Jan. 25, 1994

[51] Int. Cl.[6] ..... A63B 21/00

[52] U.S. Cl. ..... 482/73; 482/57; 482/51; 482/148

[58] Field of Search ..... 482/125, 72, 52, 53, 482/51, 57, 148

[56] References Cited

U.S. PATENT DOCUMENTS

| | | | |
|---|---|---|---|
| 4,684,126 | 8/1987 | Dalebout et al. | 482/57 |
| 5,039,088 | 8/1991 | Shifferaw | 482/72 |
| 5,042,797 | 8/1991 | Graham | 482/72 |
| 5,104,363 | 4/1992 | Shi | 482/72 |
| 5,295,931 | 3/1994 | Dreibelbis et al. | 482/125 |

*Primary Examiner*—Stephen R. Crow
*Attorney, Agent, or Firm*—Bacon & Thomas

[57] ABSTRACT

A horizontal stepper apparatus including a pair of pedal assemblies connected to a pair of cable and pulley assemblies may be used to simultaneously exercise the arms and legs of a user, with resistence force being provided by a hydraulic cylinder. The apparatus may alternatively be utilized to separately exercise the arms by rotating a seat 180°.

4 Claims, 4 Drawing Sheets

HORIZONTAL STEPPER

BACKGROUND OF THE INVENTION

The present invention relates to a horizontal stepper for exercising the arms and the legs.

Various step machines have been disclosed for exercising the legs, and have appeared on the market. These step machines are operated when the user stands on the pedals and steps. These vertical step machines are not suitable for those people who are receiving physical therapy to train the muscles of the legs. U.S. Pat. No. 5,104,363 discloses a horizontal type step machine for stepping when the user is seated. However, this type of step machine has drawbacks. Because the pedals are disposed at a higher elevation than the seat, the user must bend the body through a big angle, thereby causing a pain to the abdomen. Frequently sitting in this posture may force the spine to deform. Another drawback of this type of step machine is that the handlebars can only be moved in a fixed course, therefore the moving space of the hands is limited.

SUMMARY OF THE INVENTION

The present invention has been accomplished to provide a horizontal step machine which eliminates the aforesaid drawbacks. It is therefore the principal object of the present invention to provide an ergonomically engineered horizontal step machine which allows the user to sit on the seat thereof comfortably without causing any gymnastic injury when using the machine. It is another object of the present invention to provide a horizontal step machine which has pull ropes for pulling by the hands of the user and which permits the hands to move in all directions while pulling.

DETAILED DESCRIPTION OF THE PREFERRED EMBODIMENT

Figure 1:
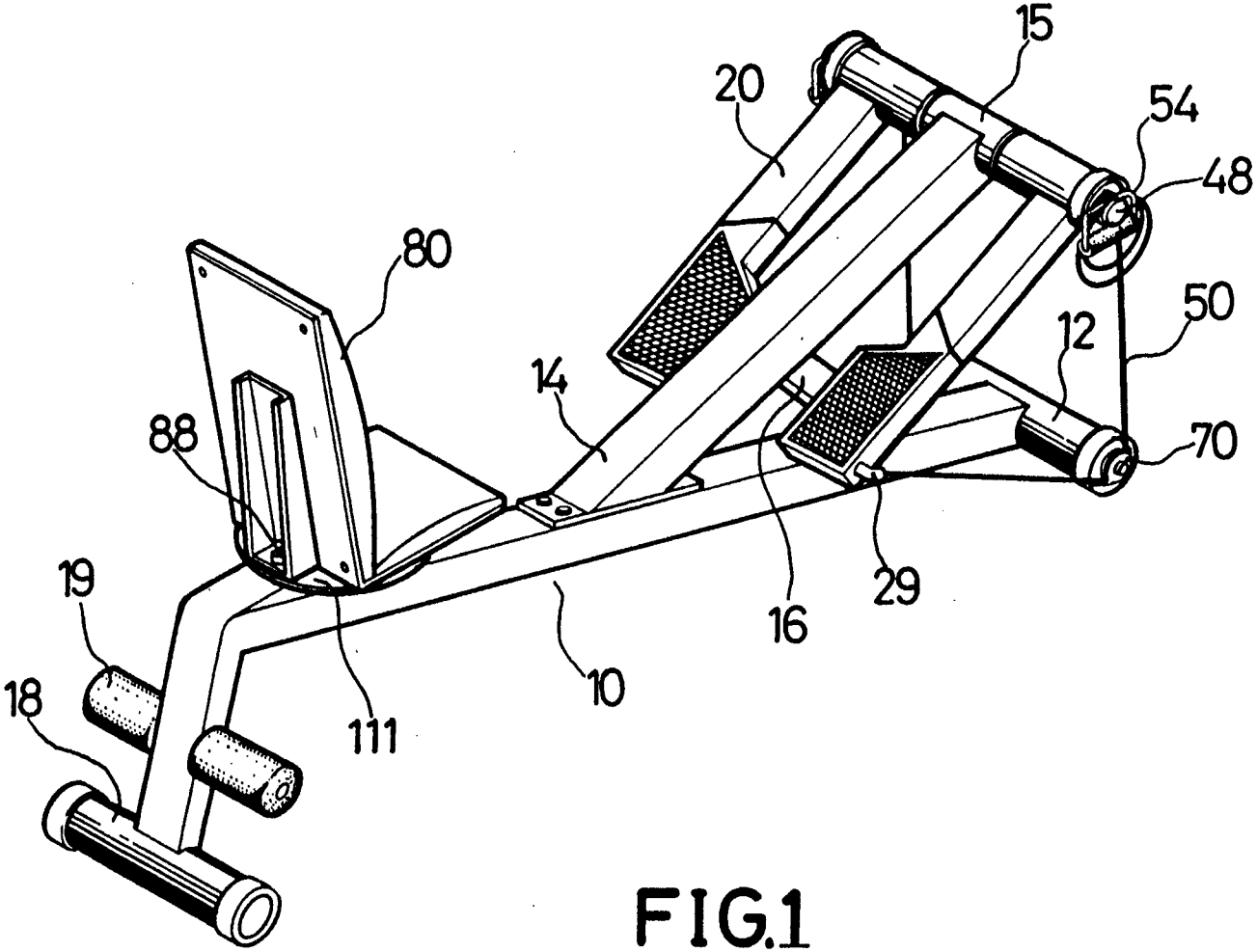
FIG. 1 is an elevational view of a horizontal stepper according to the preferred embodiment of the present invention.
Figure 2:
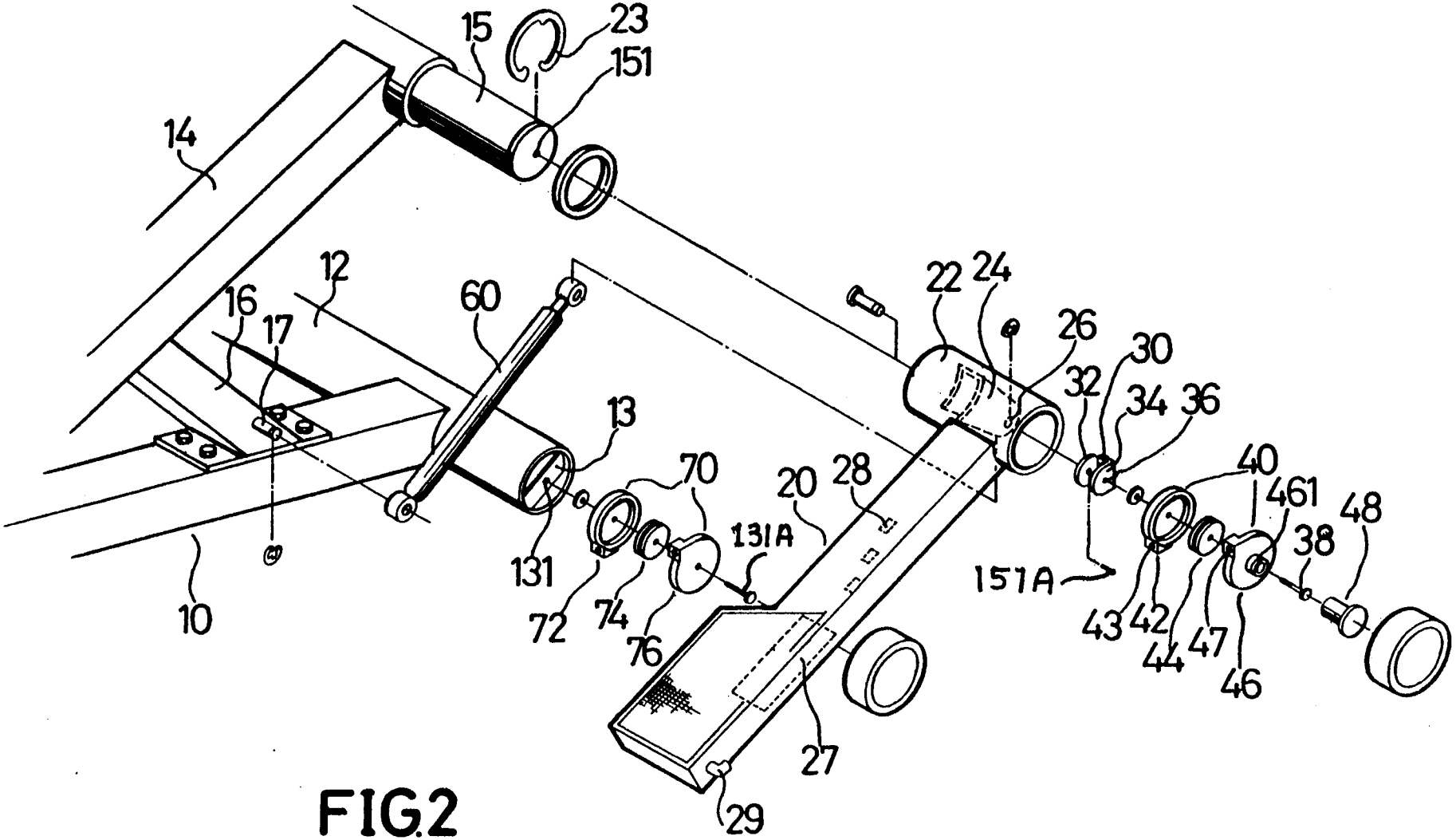
FIG. 2 is an exploded view of the horizontal stepper shown in FIG. 1.
Figure 4:
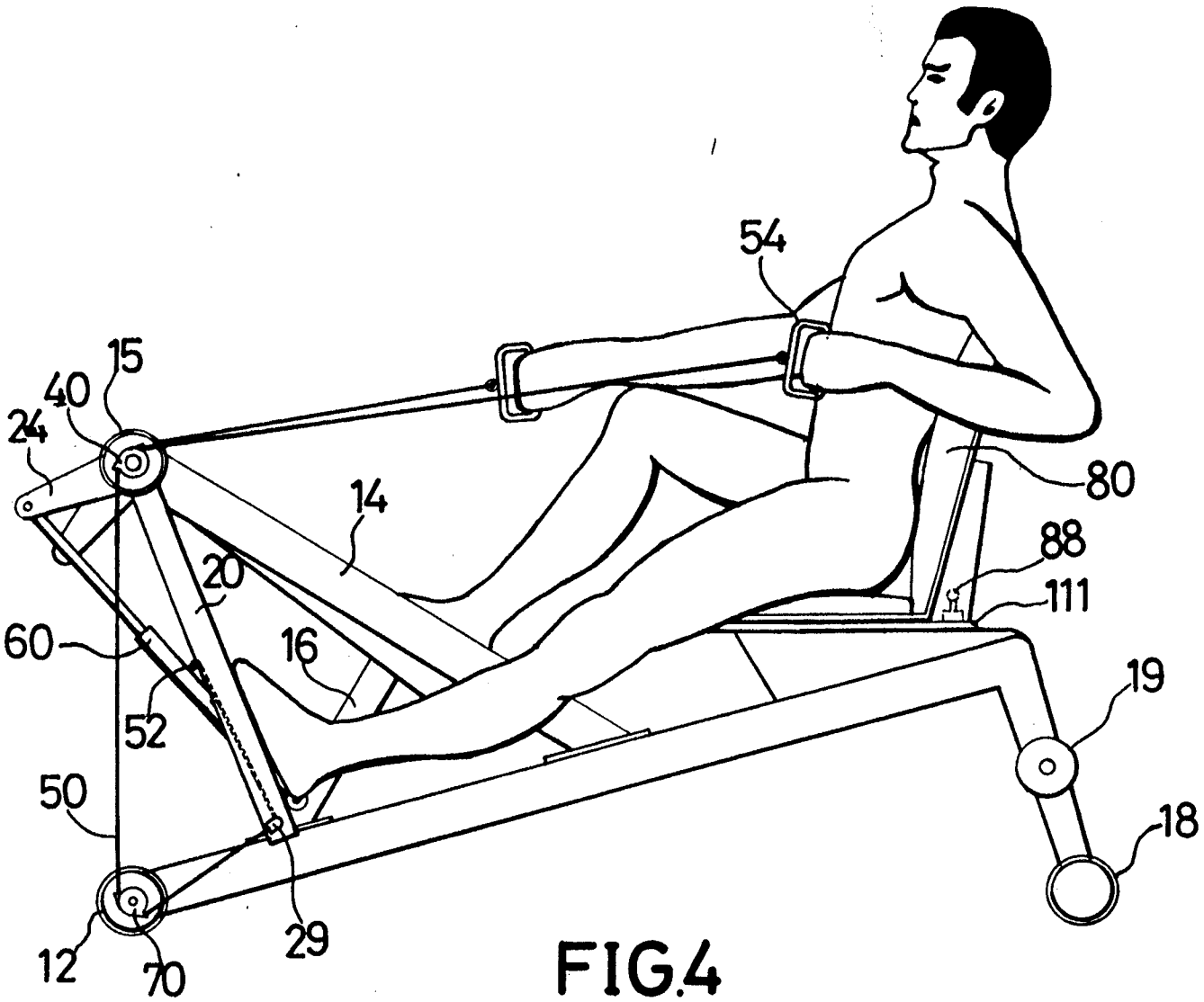
FIG. 4 is a side view of the horizontal stepper during its operation.

Referring to FIGS. 1, 2, and 4, a base frame 10 includes a top portion disposed in a sloping position relative to the ground, and includes two opposite ends respectively supported on a front transverse tube 12 and a rear transverse tube 18. A bevel support member 14 is fastened to the base frame 10 at the top middle portion to hold a horizontal top rod 15. A brace 16 is supported between the bevel support 14 and the base frame 10. A horizontal foot rod 19 is mounted on the base frame 10 and spaced above the rear transverse tube 18. The horizontal foot rod 19 is preferably covered with a layer of soft covering for resting the feet comfortably. Two pedals 20 are respectively pivotally secured to the ends of horizontal top rod 15. Each pedal 20 comprises a barrel 22 at one end mounted around an end of horizontal top rod 15 and retained in place by a clamp 23. The horizontal top rod 15 has a screw hole 151 at each end to which a fixed leaf 32 of a hinge 30 is fastened by a screw 151A. A movable leaf 34 of the hinge 30 has a screw hole 36 to which a first pulley assembly 40 is fastened by a screw bolt 38. The first pulley assembly 40 comprises an inner casing 42 having a wire hole 43, a pulley 44, an outer casing 46 having a wire hole 47, and a hanging rod 48. The pulley 44 is received within the inner casing 42 and the outer casing 46. The wire holes 43;47 are disposed tangent to the periphery of either casing 42;46 in reversed directions. A rope 50 is inserted through the wire hole 43 on the inner casing 42 and wound around the pulley 44 for one turn and then extend out of the wire hole 47 on the outer casing 46. The outer casing 46 further includes a lug 461 to which the hanging rod 48 is fastened. The barrel 22 of each pedal 20 includes a downward projecting plate 24 on the outside. The downward projecting plate 24 has a mounting hole 26 to which a hydraulic cylinder 60 is fastened. The hydraulic cylinder 60 has one end connected to the downward projecting plate 24 and an opposite end connected to a peg 17 at one side of the brace 16. The pedal 20 is of a hollow structure having a bottom access hole 27 and a series of hanging holes 28. The rope 50 has a hook 52 at one end disposed inside the pedal 20 and hooked on a hanging hole 28. The opposite end of the rope 50 extends out of the pedal 20 through a bent tube 29 thereof, inserted through a second pulley assembly 70 at one end of the front transverse tube 12, inserted through the first pulley assembly 40, and then coupled with a handle 54. The bottom access hole 27 is for inserting a hand for arranging and mounting the rope 50. The front transverse tube 12 comprises a locating plate 13 at each end. The locating plate 13 has a screw hole 131 to which the second pulley assembly 70 is fastened by a screw 131A. The second pulley assembly 70 comprises an inner casing 72, a pulley 74, and an outer casing 76. The structure of the second pulley assembly 70 is similar to the first pulley assembly 40, however the outer casing 76 of the second pulley assembly 70 does not have the lug 461. When the horizontal stepper is not being used, the handle 54 can be hung on the hanging rod 48.

As indicated, the hydraulic cylinder 60 has one end connected to the connecting plate 24 on the barrel 22 of the pedal 20 and an opposite end connected to the peg 17 at one side of the brace 16. Therefore the hydraulic cylinder 60 serves as a damper which provides a damping force to the pedal 20 when the pedal 20 is stepped or pulled by the rope 50.

Figure 3:
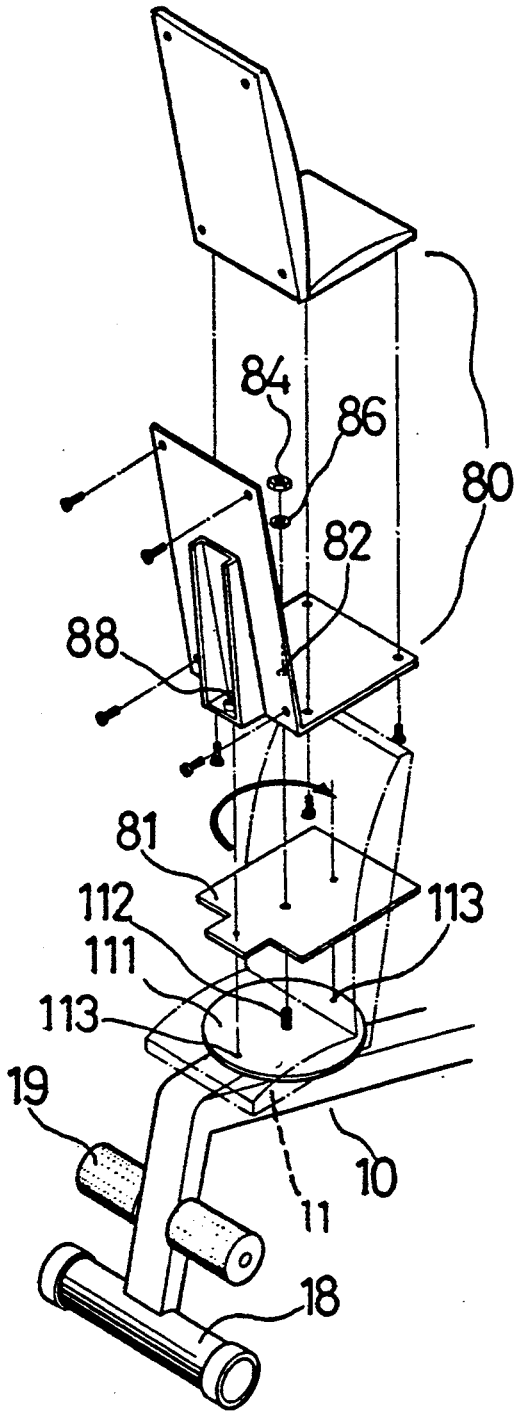
FIG. 3 is an exploded view of the seat of the horizontal stepper shown in FIG. 1.

Referring to FIG. 3, a flat block 11 is mounted on the top of base frame 10 at near the rear thereof above the horizontal foot rod 19 to hold a mounting disk 111. The mounting disk 111 has an upright screw rod 112 in the center, to which a seat 80 is fastened, and two plug holes 113 at two opposite locations along the axial direction of the base frame 10. The seat 80 has a through hole 82 at the bottom fastened to the upright screw rod 112 by a nut 84 and a washer 86, and a spring-supported bolt 88 which may be alternatively inserted into either plug hole 113. By pulling the spring-supported bolt 88 out of the plug hole 113, the seat 80 can be turned on the upright screw rod 112 to change the position. In order to stabilize the seat 80 on the mounting disk 111, a cushion 81 is mounted on the upright screw rod 112 and retained between the mounting disk 111 and the seat 80.

Referring to FIG. 4 again when in use, the user sits on the seat 80 with the feet stepping on the respective pedals 20 and the hands pulling the respective ropes 50. Because the first pulley assembly 40 is fastened to the respective hinge 30, the first pulley assembly 40 can be moved outwards relative to the barrel 22 of the respective pedal 20 within a limited range. Furthermore, the first pulley assembly 40 can be turned on the respective screw bolt 38, permitting the user to pull the rope 50 back and forth at different elevations.

The stepper may be used in another manner to exercise the arms. The seat 80 is turned through an 180° angle and fixed in the reversed direction. The hook 52 of the rope 50 at either side is disconnected from the respective hanging hole 28 for permitting it to be stopped at the respective bent tube 29, and then the user sits on the seat 80 with the back facing toward the horizontal top rod 15 and the legs inserted through the space between the rear transverse tube 18 and horizontal foot rod 19, and the user can then pull the ropes 50 at two opposite sides with the hands.

As indicated, the arrangement of the first and second pulley assemblies 40;70 and the hinge 30 at each side of the horizontal stepper permits the User to move the hand within a broad area from the body while pulling the respective rope 50 back and forth.

While only one embodiment of the present invention has been shown and described, it will be understood that various modifications and changes could be made without departing from the spirit and scope of the invention.

What is claimed is:

1. A horizontal stepper comprising:

a) a base frame having a top portion disposed in a sloping position, a front transverse tube and a rear transverse tube at opposite ends of the base frame, a horizontal foot rod disposed above the rear transverse tube, a bevel support member mounted on the top portion and at the middle thereof, a brace supporting the bevel support member, a horizontal top rod mounted on the bevel support member, and a seat mounting disc mounted on the top portion at one end thereof above the horizontal foot rod;

b) a seat, means for mounting the seat on the seat mounting disc and means for locking the seat in a desired position;

c) a pair of hinges secured to opposite ends of the horizontal top rod and a pair of first pulley assemblies secured to the hinges;

d) a pair of second pulley assemblies secured to opposite ends of the front transverse tube;

e) a pair of hollow pedals rotatably mounted to opposite ends of the horizontal top rod, each pedal including a barrel at a first end of the pedal, with each barrel being mounted around an end of the horizontal top rod, a bent tube at an opposite end of each pedal, and an access hole and a plurality of spaced hanging holes at a bottom of each pedal; and f) a pair of ropes, each rope having one end inserted through a bent tube of a pedal and provided with a hook for detachably hooking the one end on a selected hanging hole of the pedal, an opposite end inserted through a second pulley assembly, and a handle coupled with the opposite end.

2. The horizontal stepper of claim 1 wherein each hinge includes a fixed leaf secured to an end of the horizontal top rod and a moveable leaf hinged to the fixed leaf, the moveable leaf being secured to a first pulley assembly.

3. The horizontal stepper of claim 2 wherein each first pulley assembly includes an inner casing, an outer casing covering the inner casing, a pulley disposed within the inner and outer casings, a screw bolt extending through the inner and outer casings and the pulley, the screw bolt being secured to the moveable leaf of a hinge to permit the inner and outer casings and the pulley to be turned thereon, the inner and outer casings each having a respective wire hole tangentially positioned on the periphery of each casing in reversed directions and through which the respective rope passes, and the outer casing including a hanging rod secured thereto for hanging a handle of the rope.

4. The horizontal stepper of claim 1 further including a pair of hydraulic cylinders, each barrel including a connecting plate, each hydraulic cylinder including one end connected to the connecting plate of a barrel, and an opposite end connected to the brace.

* * * * *